US005611641A

United States Patent [19]

Christensen

[11] Patent Number: 5,611,641

[45] **Date of Patent: *Mar. 18, 1997**

[54] CROWD CONTROL BARRIER SYSTEM

[76] Inventor: Marc E. Christensen, 364 N. Main St., #2, Salt Lake City, Utah 84103

[ * ] Notice: The term of ths patent shall not extend beyond the expiration date of Pat. No. 5,452,963.

[21] Appl. No.: 533,738

[22] Filed: Sep. 26, 1995

Related U.S. Application Data

[63] Continuation-in-part of Ser. No. 278,495, Jul. 20, 1994, Pat. No. 5,452,963.

[51] Int. Cl.[6] ..... E01F 13/02

[52] U.S. Cl. ..... 404/6; 404/7; 256/1

[58] Field of Search ..... 404/6, 9, 10, 11, 404/7, 8, 34, 41; 256/1, 13.1

[56] References Cited

U.S. PATENT DOCUMENTS

| | | | |
|---|---|---|---|
| D. 349,738 | 8/1994 | Naegele, III et al. . | |
| 2,794,375 | 6/1957 | Di Falco | 404/7 |
| 3,822,954 | 7/1974 | Ansgariusson | 404/7 |
| 4,380,327 | 4/1983 | Fish . | |
| 4,681,302 | 7/1987 | Thompson | 256/13.1 |
| 4,854,767 | 8/1989 | Sasaki | 404/6 |
| 4,943,035 | 7/1990 | Thomson et al. . | |
| 5,208,585 | 5/1993 | Sprague | 404/6 X |
| 5,213,312 | 5/1993 | MacDonald . | |
| 5,269,623 | 12/1993 | Hanson . | |
| 5,460,353 | 10/1995 | Rittenhouse . | |

FOREIGN PATENT DOCUMENTS

| | | | |
|---|---|---|---|
| 442249 | 8/1991 | European Pat. Off. | 256/13.1 |
| 2660945 | 10/1991 | France | 256/13.1 |
| 1658470 | 10/1970 | Germany | 404/7 |
| 942255 | 11/1963 | United Kingdom | 404/7 |
| 2219332 | 12/1989 | United Kingdom | 256/13.1 |

*Primary Examiner*—James A. Lisehora
*Attorney, Agent, or Firm*—Workman, Nydegger & Seeley

[57] ABSTRACT

A portable crowd control barrier for use in sporting or entertainment events having lightweight body members formed of a resiliently deformable material and each defining an interior chamber and having slots formed in end walls thereof to receive wooden studs such that the introduction of liquid into the interior chambers deforms the body members, clamping the walls of the slots against the studs and locking the system in place.

23 Claims, 9 Drawing Sheets

CROWD CONTROL BARRIER SYSTEM

RELATED APPLICATIONS

This application is a continuation-in-part of Ser. No. 278,895 filed Jul. 20, 1995 now U.S. Pat. No. 5,452,963, entitled "CROWD CONTROL BARRIER," which will issue Sep. 26, 1995 in the name of Marc E. Christensen.

BACKGROUND OF THE INVENTION

1. The Field of the Invention

The present invention relates to a portable reusable barrier system, and more particularly, a barrier system for use with activities such as athletic events which require a temporary, predefined field layout or for use with entertainment events having a stage where a discreet distance between spectators and the stage is desired to be maintained.

2. The Relevant Technology

In the past, portable event barriers have generally been relatively expensive and difficult to erect and disassemble before and after athletic events. Generally, such barriers are of a relatively low height which a spectator might easily step across. The basic function of the prior devices was merely to outline the area of play and the area beyond which it was desired to maintain control of spectators.

When more positive crowd control has been required, concrete barriers have been utilized. The advantage of added height and weight are outweighed, however, by the need for special equipment to handle the heavy barrier sections in the tight quarters required in stadium or indoor events.

SUMMARY AND OBJECTS OF THE INVENTION

It is an object of this invention to provide an improved crowd control barrier system which is relatively light in weight for ease of transportation yet may be ballasted after positioning to provide a heavier barrier.

It is another object of the present invention to provide a crowd control barrier having sufficient height to control access of a crowd to the playing or entertainment area while permitting the spectators to nevertheless view the event.

It is another object of the present invention to provide a crowd control barrier which may be easily positioned in the desired configuration and rigidly locked into place.

It is yet another object of the present invention to provide a temporary barrier system which will yield slightly upon impact to lessen the damage to an object or individual colliding with the barrier.

It is a further object of the present invention to provide a portable barrier system that is difficult to topple.

It is a still further object of the present invention to provide a barrier system which may be easily unballasted and reused.

The above objects are provided by the crowd control barrier of the present invention which comprises an elongated hollow container having a base portion, side walls extending upwardly from the base portion and a top portion joining the upper extremities of portions of the side walls. End walls join the side walls. Means for filling and means for discharging may be formed into the unit. Furthermore, means for joining one unit to another unit are provided. In some embodiments, means for extending the height of the unit are provided.

To aid in moving the units, a pair of recesses may be formed into the base in some embodiments to permit the use of a forklift in moving and arranging the units.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
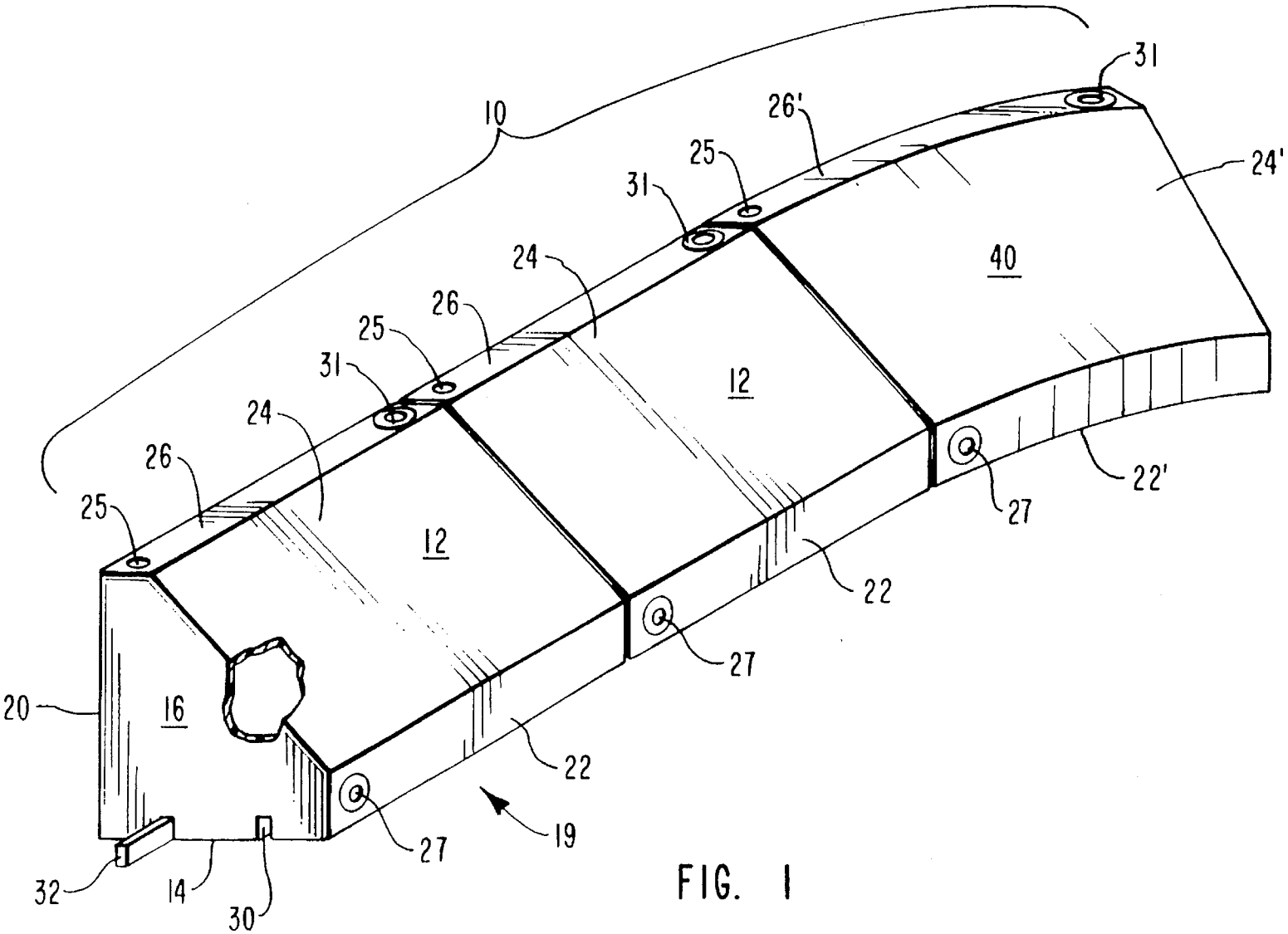
FIG. 1 is a perspective view of one embodiment the crowd control barrier of the present invention.

Referring now to FIG. 1, one embodiment of a barrier system 10 of the present invention includes a straight control barrier unit 12 and a curved control barrier unit 40 joined together. Barrier unit 12 and 40 each form an elongated hollow container having a base portion 19 with side walls 20, 22, end walls 16, and a bottom 14. Side wall 22 rises initially vertically and transitions into an intermediate wall portion 24 which extends inwardly from the upper edge of side wall 22 and terminates at approximately the same height as side wall 20. Vertical side wall 20 extends vertically a distance greater than the vertical rise of side wall 22. A top portion 26 may be utilized to join the tops of end wall 16, side walls 20, 22 and intermediate wall 24 to enclose the barrier units. Within top portion 26, a door, portions of a means for extending the height of the unit, and means for filling may also be located. For example, one embodiment of the means for filling is fill plugs formed in top 26 to permit ballast to be added to the unit. One embodiment of the present invention envisions a base footprint of 3¾ feet by 5½ feet by 4 feet and is approximately four feet high. Despite the size of the unballasted unit it is anticipated that most units will weigh less than fifty pounds. As a result, each unit should be easily manually portable.

Some embodiments of the present invention utilize means for extending the height of the unit. By way of example and not limitation, the means for extending in the embodiment depicted in FIG. 1 comprise plug 31, and vertical uprights and a net extending therebetween. Plug 31 is formed so as to receive a cylindrical upright (not shown) which may be used to support a net or the like therebetween for added safety or security. Likewise, means for discharging in this embodiment comprise a recessed drain plug 27 formed into side wall 22 to permit draining the material from the interior chamber of the barrier units when it is desired to relocate or reposition the barrier.

Figure 2A:
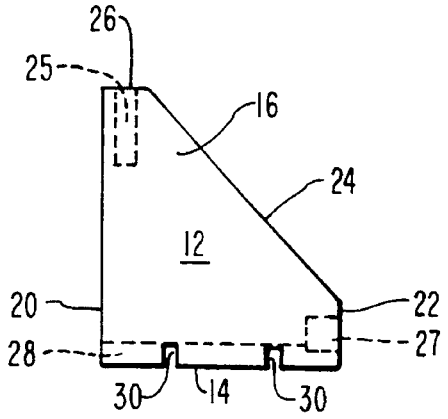
FIG. 2A is an end view of the crowd control barrier shown in FIG. 1.
Figure 2B:
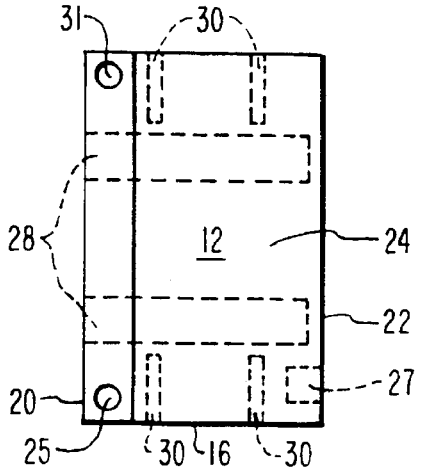
FIG. 2B is a top view of the crowd control barrier shown in FIG. 1.
Figure 2C:
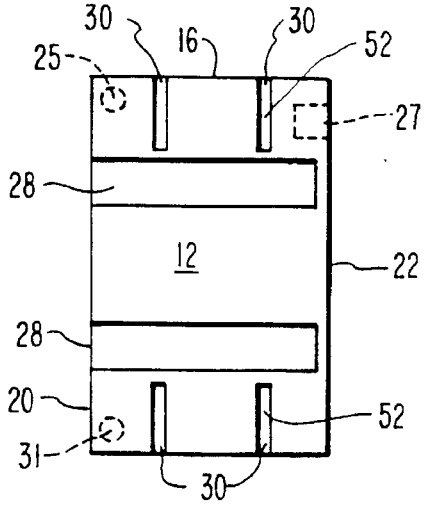
FIG. 2C is a bottom view of an alternate embodiment of the crowd control barrier.

Turning now to FIGS. 2A–2C, a plurality of notches or slots 30 are formed at the juncture of bottom 14 and end walls 16. An equal number of slots 30 are formed in each side wall 16 and extend a predetermined distance from side wall 16 toward the opposing side wall 16 of another unit (not shown). The slots are further positioned so that when an end 16 is abutted to another end 16 of a contiguous unit, the slots 30 in each end 16 are in alignment. Each slot 30 is dimensioned to receive in relatively snug fit, a standard 2"×4" wood stud or board 32 dimensioned such that when an end wall 16 of one unit 12 or 40 is abutted against an end wall 16 of a second unit 12 or 40, the 2×4 stud 32 positioned in slot 30 will be in snug contact with the surfaces of slots 30 of each unit.

A second set of slots 28 are formed at the juncture of bottom 14 and sidewall 22 and extend from sidewall 22 inwardly a predetermined distance toward side 20. The slots may extend through sidewall 22 to allow access from either side. The slots are dimensioned and spaced apart in order to receive the tines of a standard fork lift for ease in moving and transporting the barriers.

The actual embodiment will be dependent upon the type of activity for which the units 12 are utilized. If the units are utilized to delimit the playing field for a game such as hockey or the like which has a relatively small game piece which may inadvertently be knocked into one of the fork lift slots 28, the adaptation depicted in FIG. 2 showing the slots 28 extending from side 22 almost but not completely to side 20 is advantageous in that it presents a solid wall 20 in the playing area. Where, however, the playing piece used is large such as in the case of soccer, or system 10 is used as a barrier for crowd control at an enterprise where no game pieces would be utilized, the embodiment wherein fork lift slots 29 extend completely transversely through the body of the barrier of 12 would be acceptable.

Barrier units 12 are made of a resiliently deformable plastic material having strong, semi-rigid and energy absorbing properties. The materials are selected from a polymeric group which will deform under internal pressure but will not fail in a brittle manner. In addition, the material is selected to provide a smooth exterior surface on unit 12 so as to reduce abrasions from collisions of players or crowds pushing against the barrier.

When the term "semi-rigid" is used, it means that the unit 12 may be made from a material that is capable of allowing a slight flexing when water is introduced into the interior chamber of the unit 12. Although the units may be constructed of a rigid material which would hold its shape regardless of the interior loading of the water, the preferred embodiment utilizes a semi-rigid material. As will be hereinafter explained, the flexure under load becomes important to the locking mechanism by which the unit 12 are held in place when positioned for use and to cushion impact.

In practice, unit 12, while empty of any ballast material is relatively light in weight and may be easily transported to the site where it is to be used. The unit 12 may then be placed or otherwise positioned in the desired layout at the location where the control barrier 10 is needed. As the unit 12 is being positioned, 2×4 studs 32 are placed such that when end 16 is positioned against end 16 of another unit, slots 30 in the abutting units completely cover studs 32. Once positioned, liquid or other ballast is introduced into the hollow interior of unit 12.

Figure 3A:
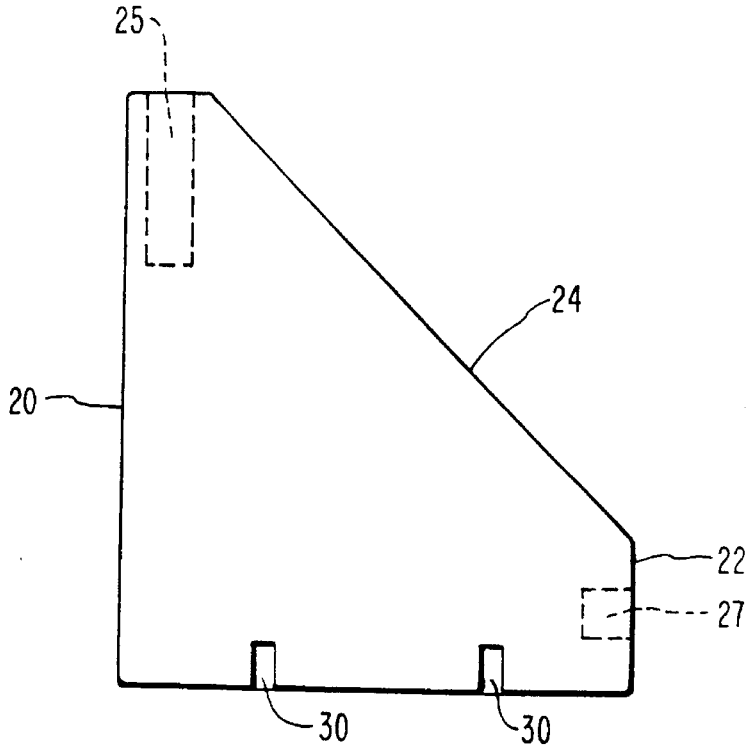
FIG. 3A is an end view of one embodiment of the crowd control barrier of the present invention.
Figure 3B:
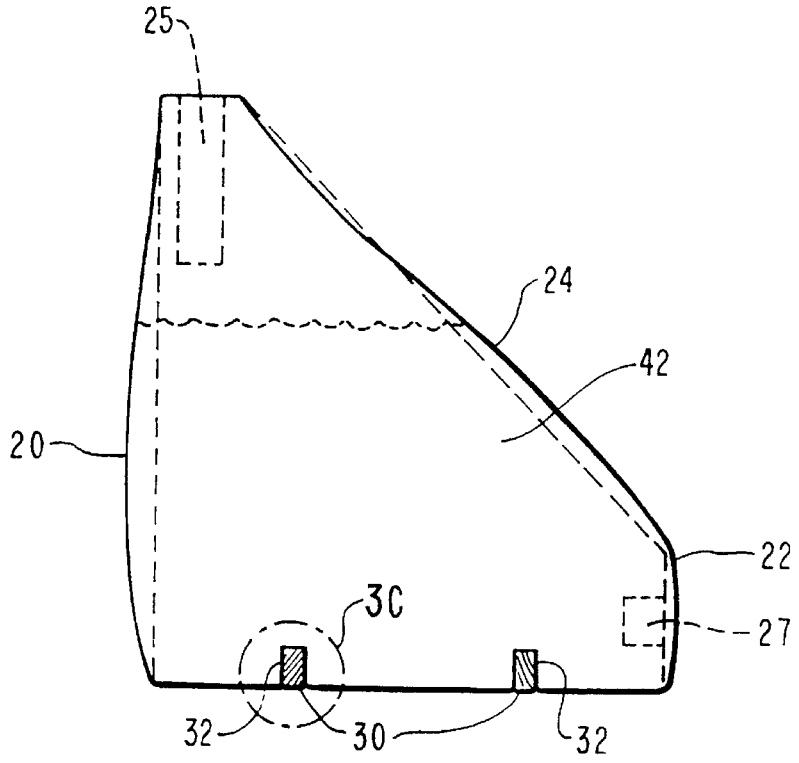
FIG. 3B is an end view of the crowd control barrier shown in FIG. 4A with material added showing the deformation of the semi-rigid plastic material.
Figure 3C:
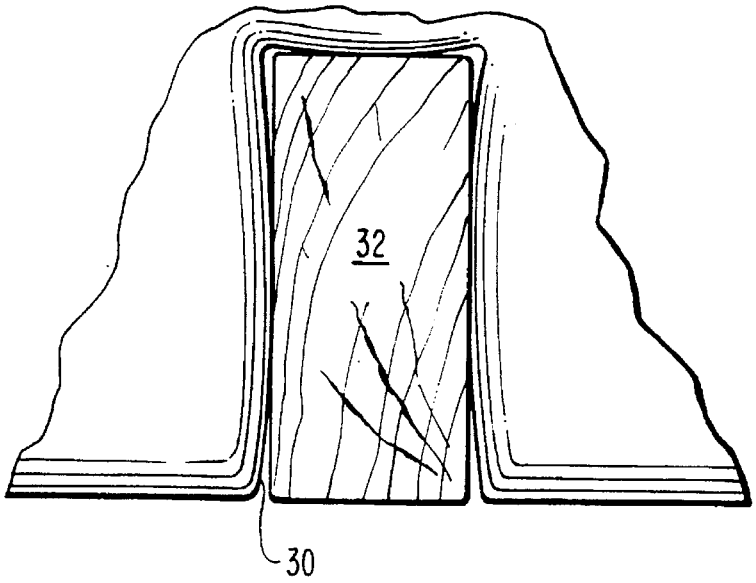
FIG. 3C is a cut out portion of the end view of FIG. 4B showing the deformation of the semi-rigid plastic.

Referring now to FIGS. 3A–3C, a unit is shown prior to, during, and after the introduction of ballast into the hollow interior. In the empty state, control barrier unit 12 may be easily moved and positioned into a desired configuration. Referring to FIG. 3B, as ballast such as water 42 is introduced into the interior chamber of the barrier 12, the weight of the liquid 42 causes a slight flexure in the vertical walls 20, 22 and 24 of barrier 12. As the pressure increases, the slot 30 tends to bow out and clamp firmly onto studs 32. Liquid 42 not only adds weight to barriers 12, 40 helping to hold them in place, but also clamps the barriers to the studs 32 so that the normal force of a crowd pushing against the barrier 10 or of a player running into the barrier 10 would not be sufficient to dislodge the two contiguous units of barrier from their positions.

Figure 4:
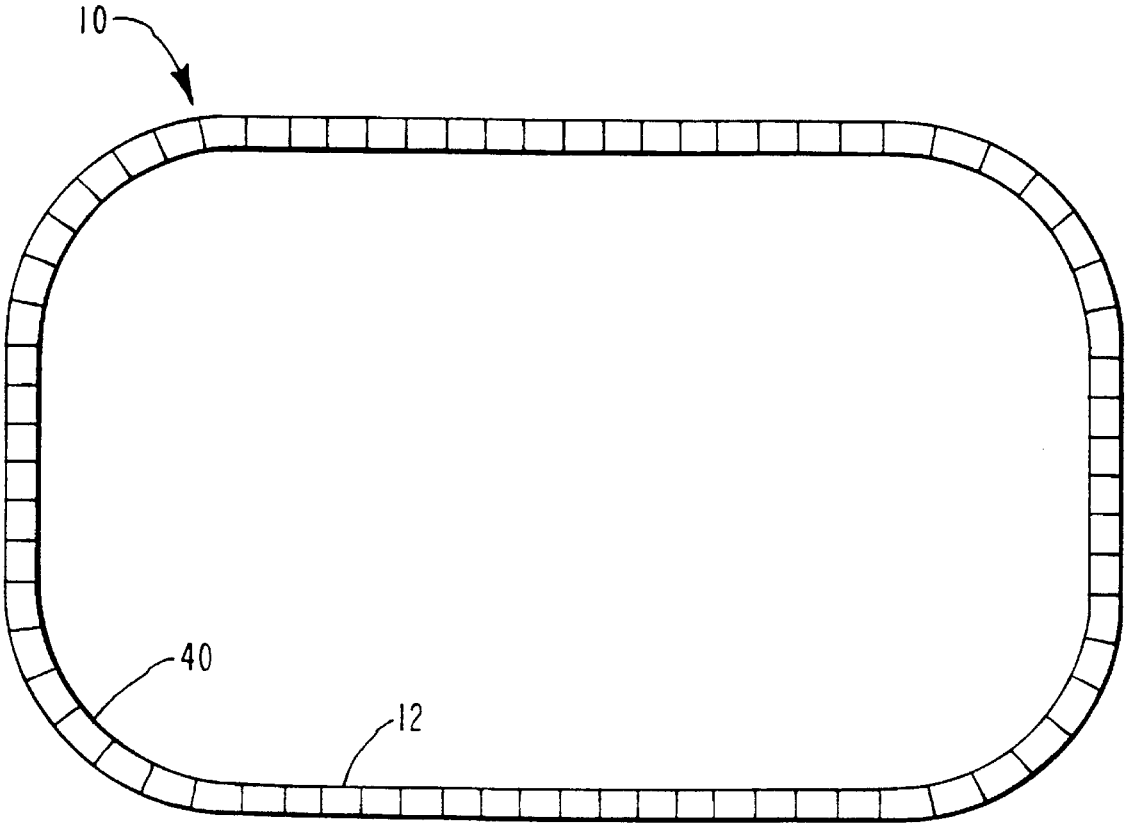
FIG. 4 is indicative of various combinations of units which may be configured.

Referring now to FIG. 4, one configuration of the control barrier system 10 is illustrated showing the flexibility by which the system can be readily configured. FIG. 4 depicts use of the barrier 10 to provide a playing field layout. It will be appreciated that the barrier may also be configured to protect a stage or display area and is only limited by the shapes of the barrier units.

Figure 5:
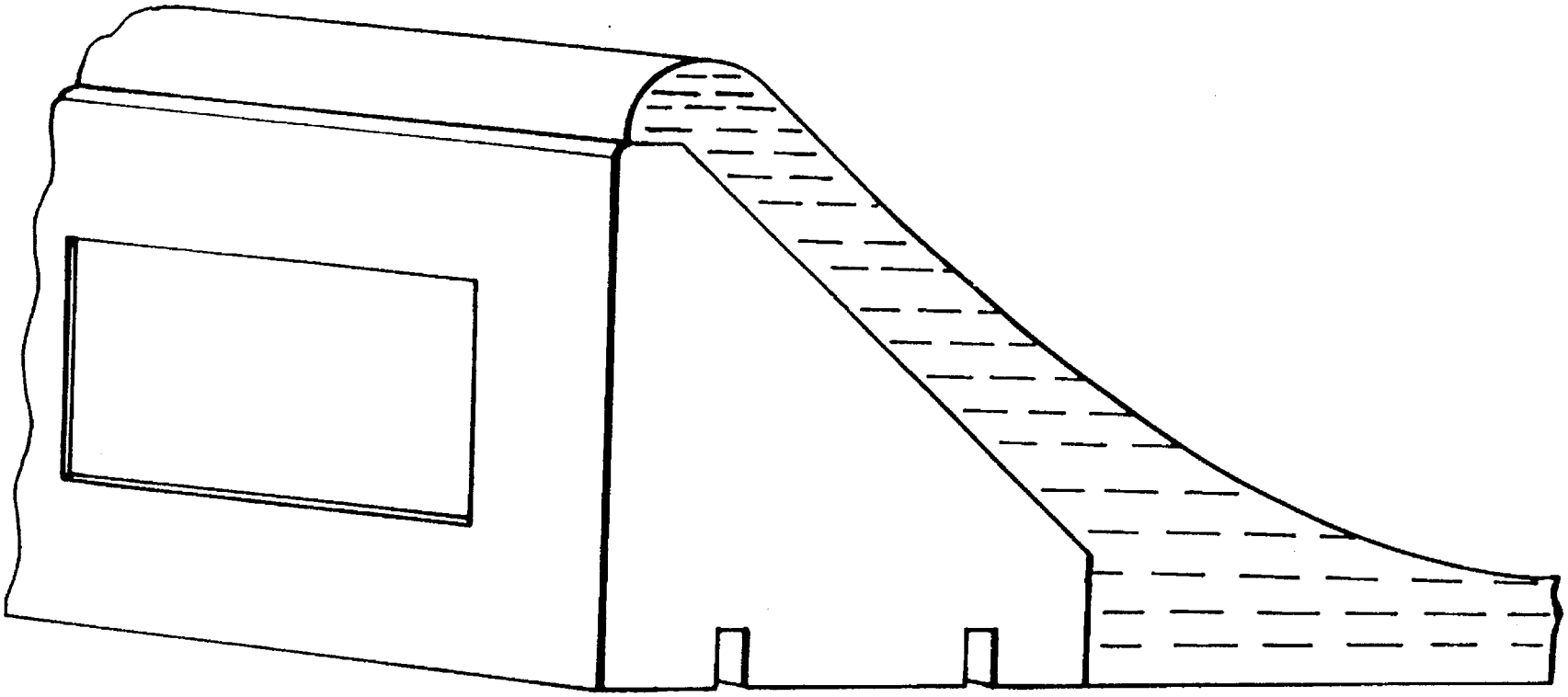
FIG. 5 is a perspective view of the barrier shown in FIG. 1 having a display inset formed thereon.

Referring now to FIG. 5, the barrier system 10 may be utilized in constructing an ice rink, a half-pipe configuration for use with snowboards and skateboards and the like, whereby snow or an ice surface 60 is placed against the sloping surface of unit 12 to provide a relatively slick surface to the users. An inset 60 is shown formed in side 20 of the unit 12. It is envisioned that advertising material may be placed in the inset and covered with a clear cover material such as plastic.

Figure 6A:
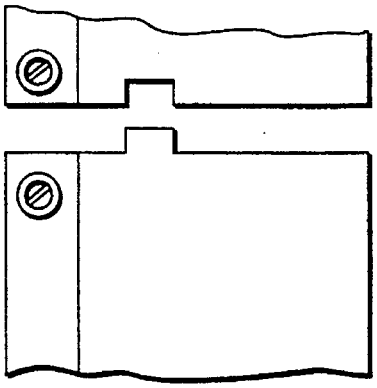
FIGS. 6A–6C illustrate embodiments of the means for interconnecting units utilizing a spline and groove.
Figure 6B:
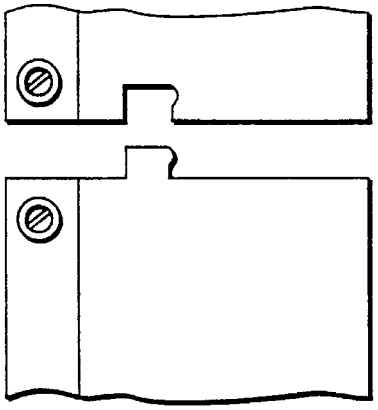
Figure 6C:
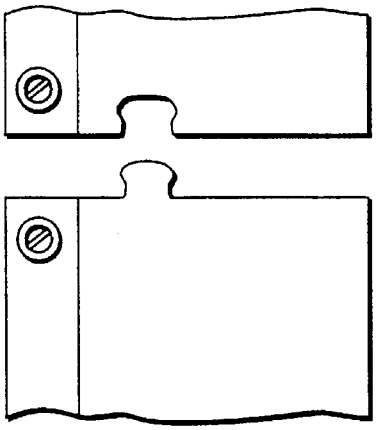

Turning now to FIG. 6, an embodiment of the present invention utilizing a different means for interconnecting units is illustrated. In this embodiment, a spline and a corresponding groove are incorporated into opposing ends of two barrier units. Before ballasting, the spline is introduced and interengaged with the groove to form a friction resistance lock between the two units. Although this is not a positive lock in that the units may be separated horizontally, it does distribute loads on impact so that more than one unit provides resistance to an impact upon one unit. The spline and groove are finished to provide a tight frictional engagement. This may be accomplished by sandblasting the polyethylene after molding or by other methods known in the art. This embodiment is constructed of heavy duty polyethylene, which not only provides rugged strength, but is also semi-rigid. As discussed previously, semi-rigid materials are preferred because of the ability of the material to expand and deform slightly upon ballasting.

This deformation is especially important as the deformation assists in the interlocking of contiguous units. Although the friction fit between the spline and groove in the embodiment in FIG. 6 provides some resistance, upon ballasting, the groove and the spline both expand and deform so as to greatly increase the frictional engagement between the two units. The units are designed so that the tolerances between the spline and groove are such that this deformation greatly increases the frictional engagement of the spline within the groove. This is particularly advantageous when the spline is not smooth but instead incorporates structures such as a t-shaped end which is capable of passing through the recess before ballasting, but which cannot be removed from the recess after the unit is deformed. This has the special advantage in that a positive lock may be achieved while still allowing the units to be assembled horizontally.

A second advantage of using polyethylene is that the material provides some cushioning when filled with a water ballast. This cushioning is especially important when the barrier is utilized in athletic events such as hockey where players often impact the barrier. To assist in this cushioning, shredded polystyrene may be included with the water and an antifreeze may be required to maintain the water in a liquid state to preserve the cushioning effect at temperatures below the freezing level of water. Gels may also be utilized.

Another advantage of the embodiment illustrated in FIG. 6 is that there is a large portion of the barrier unit which is vertical and can be viewed by the audience attending the event. This space may be used for advertising and in the embodiment issued in FIG. 6, a clear plastic flap is provided for covering the advertisement thereby protecting it from damage from weather. The other advantage of the clear plastic covering flap is that the advertisement may be removed and replaced in an easy manner. Although the embodiment illustrated in FIG. 6 has a drain hole 70 for removing liquid ballast, solid ballast may also be removed through an access panel 72 located within the top of the barrier unit.

Because the embodiment in FIG. 6 has an angled wall, it is much more difficult for audience members to climb over the barrier. This is especially true when the angled wall is constructed out of polyethylene which is slippery.

Figure 7:
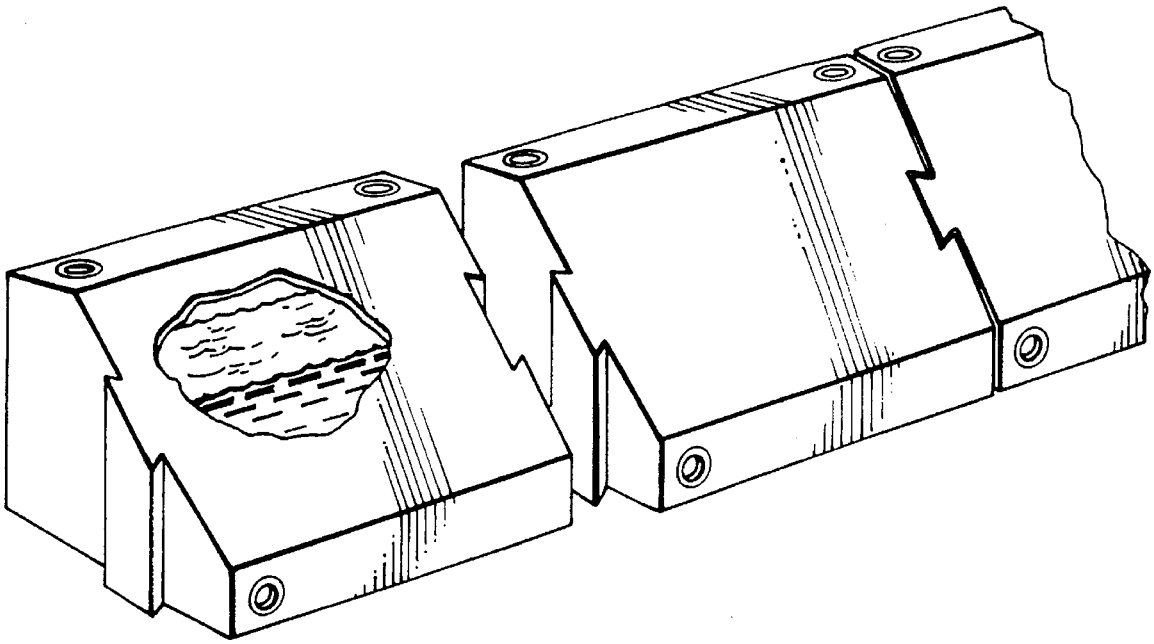
FIG. 7 illustrates a mortise and tenon dovetail unit.

Turning now to FIG. 7, another embodiment of the present invention is illustrated. This embodiment also uses means for interlocking two contiguous units which in this embodiment comprise a dove-tail type locking relationship. One end wall of the barrier unit has a flared tenon whereas the other end has a corresponding mortise. The advantage to this embodiment is that the units have a positive lock and cannot be pulled apart horizontally. This is especially beneficial in applications where pressure will be applied to the wall or where large crowds are expected to impact the wall. The disadvantage of the positive lock is that each unit must be lifted above the level of the previous unit and the mortise engage with the tenon and be slid downwardly next to the previously positioned unit in order to effect the interlocking engagement. Because of this, and because of the benefits of the positive interlock, it may not be desirable to ballast each unit within the barrier wall. For applications where a high load is expected, each unit should be ballasted. In other applications, however, it may be desirable to ballast only every third unit to take full advantage of the positive interlock of the intervening units. In applications where the wall will be curved such as when used to surround a temporary ice rink, the positive interlock function of both this dove-tail arrangement and the other positive interlocking arrangements described herein allow for the use of the barrier wall without any ballasting. The curve of the rink and the positive interlock prevent the units from being separated or from being toppled. This provides for a very strong, yet lightweight wall which can be easily moved.

Figure 8:
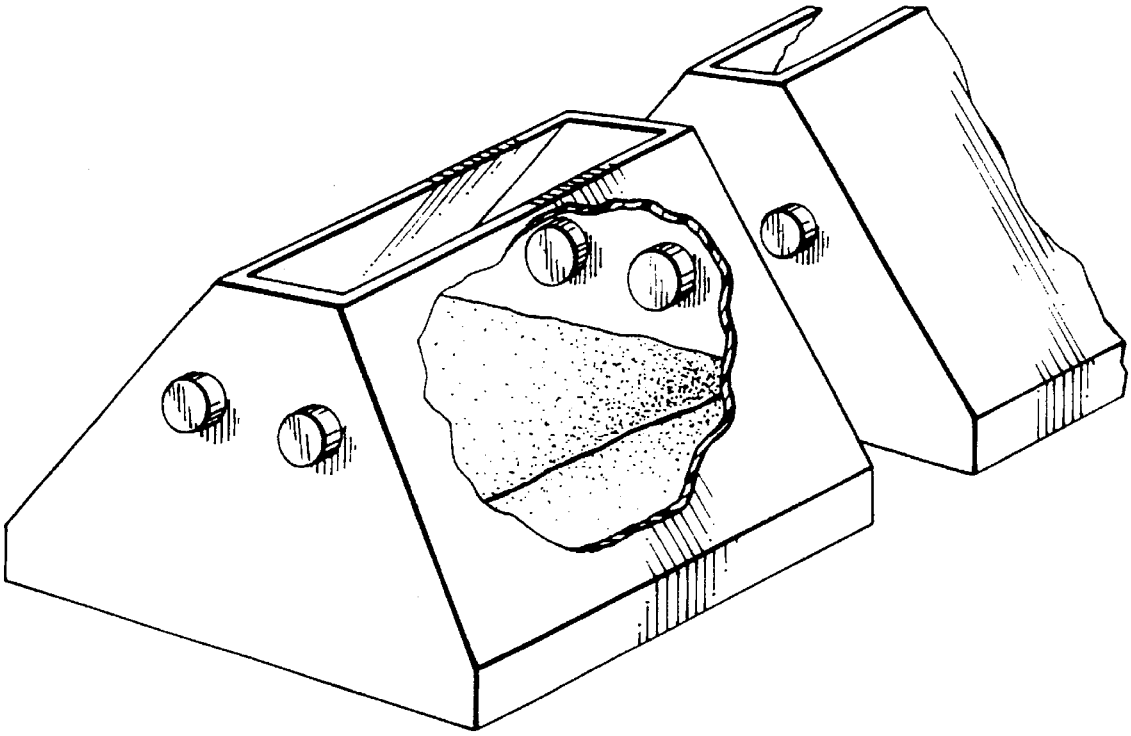
FIG. 8 illustrates a peg and recess unit.

Yet another embodiment of the present invention is illustrated in FIG. 8. This embodiment uses a multiple peg and recess interlocking system. This is a horizontal interlocking system which does not require the vertical engagement of contiguous units. This embodiment is also equipped with a means for interlocking contiguous units which, in this embodiment, comprises several pegs protruding from one end of the unit and a corresponding set of recesses formed within the contiguous end of a unit. The two unit end walls are merely pressed together to form a frictional interlock. As with other embodiments, however, when a liquid or fluid ballast is introduced, the semi-rigid material from which the unit is constructed deforms slightly thereby increasing the frictional engagement between the two units.

Although many of the illustrations depicting these various embodiments illustrate straight units of barrier, it will be appreciated that the shape of individual units can be varied. In order to effect an oval shape necessary for surrounding an ice rink, several curved and straight units can be used in combination. It will be appreciated that many interlockable shapes beyond these illustrated can be created utilizing the principals of the present invention.

Figure 9:
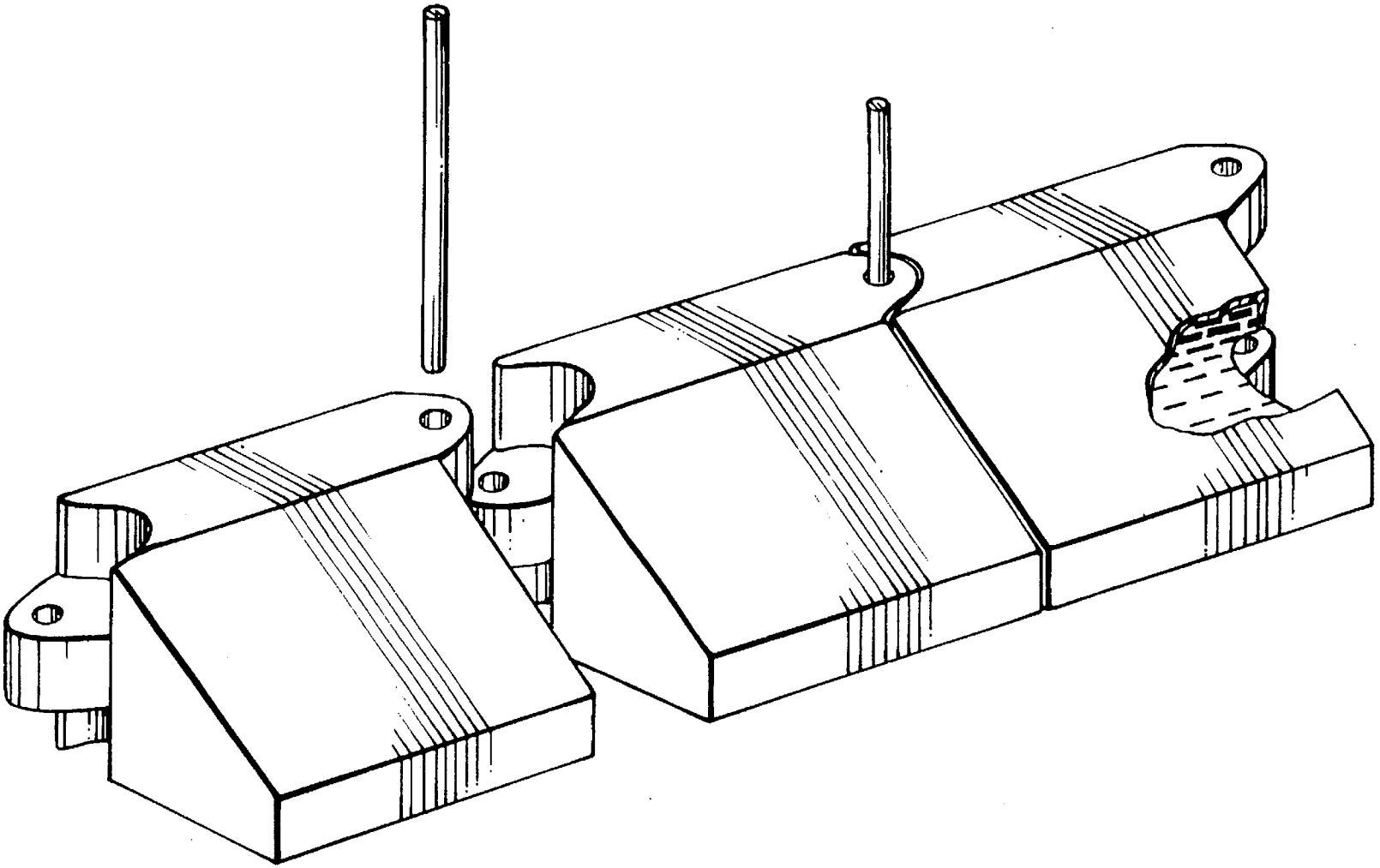
FIG. 9 illustrates a hinge assembly for connecting adjacent container units.
Figure 10:
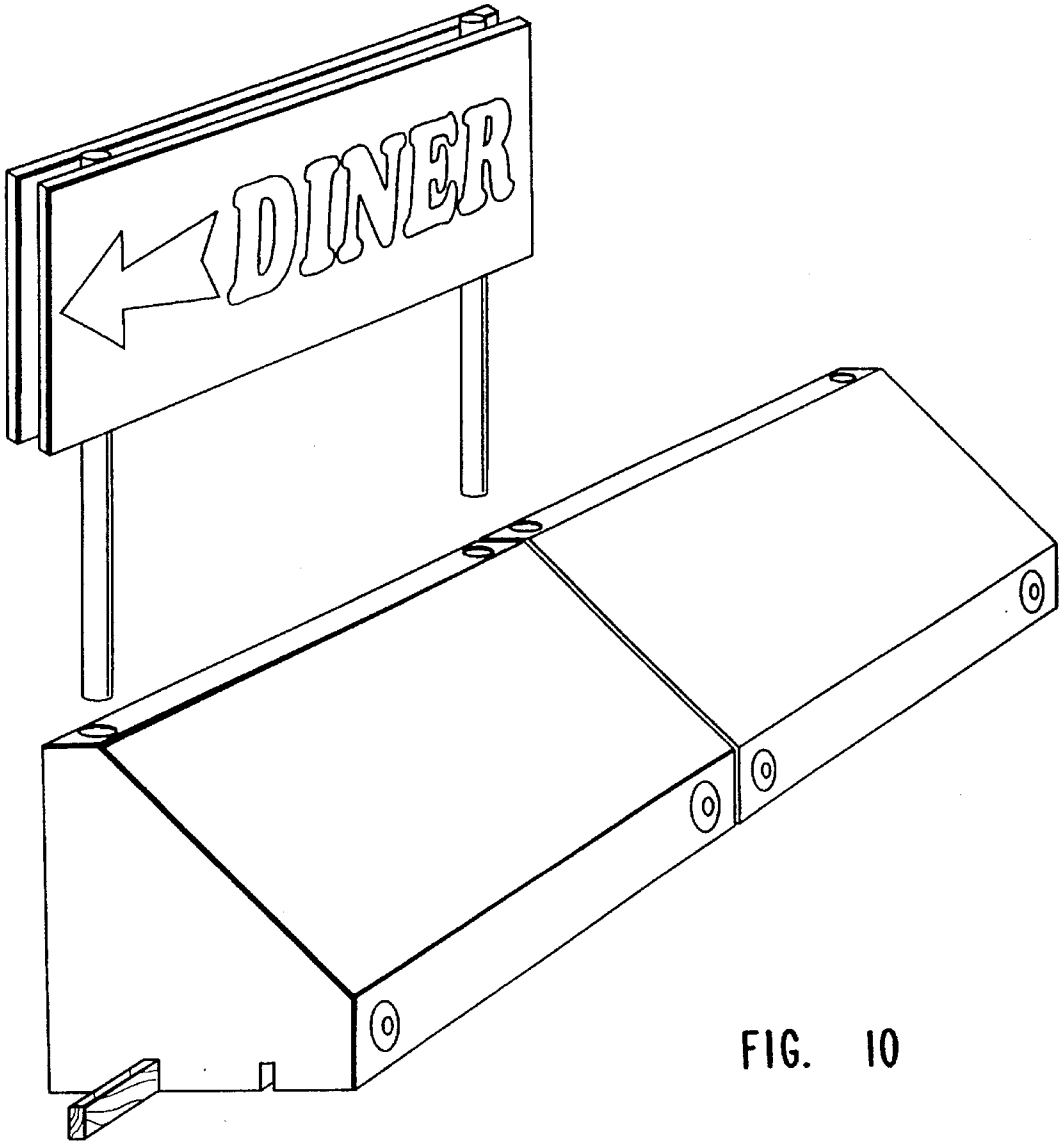
FIG. 10 illustrates the inventive barrier container having an advertising sign projecting above the height of the container.
Figure 3A:
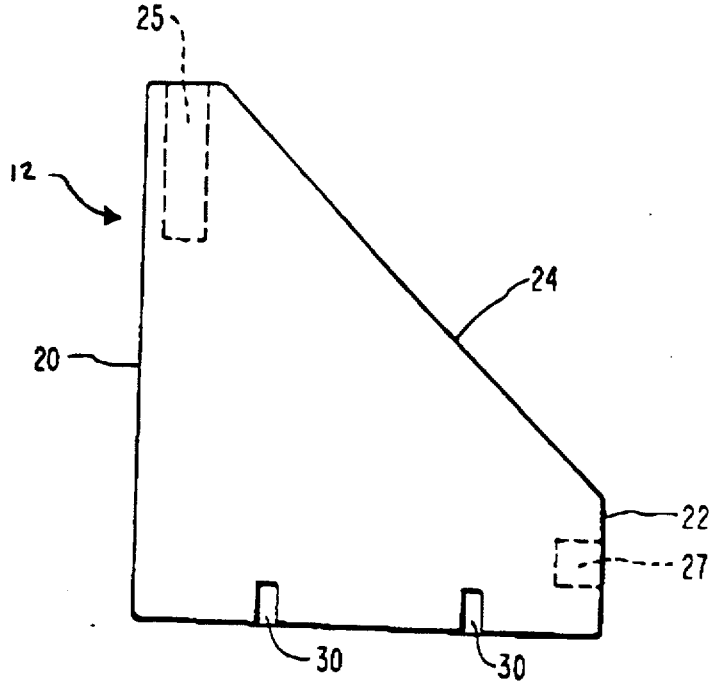
Figure 3B:
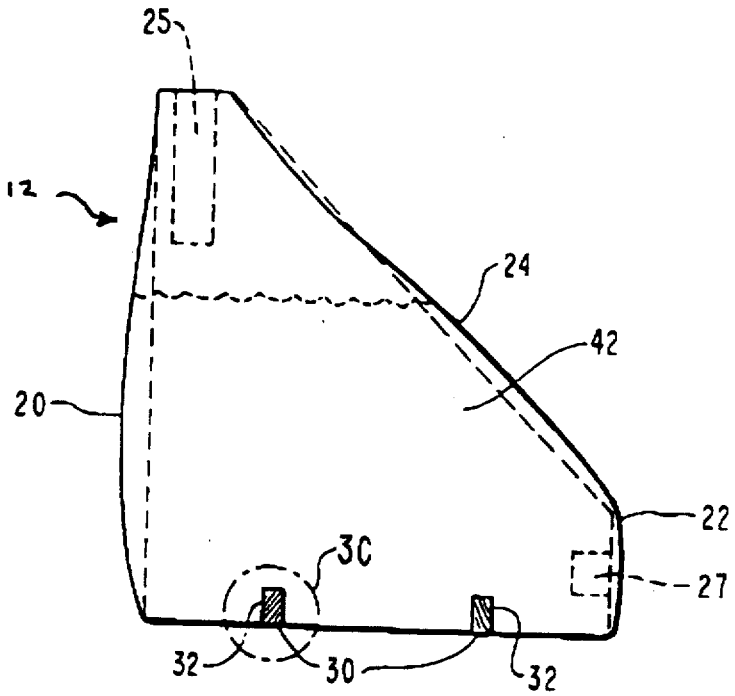
Figure 5:
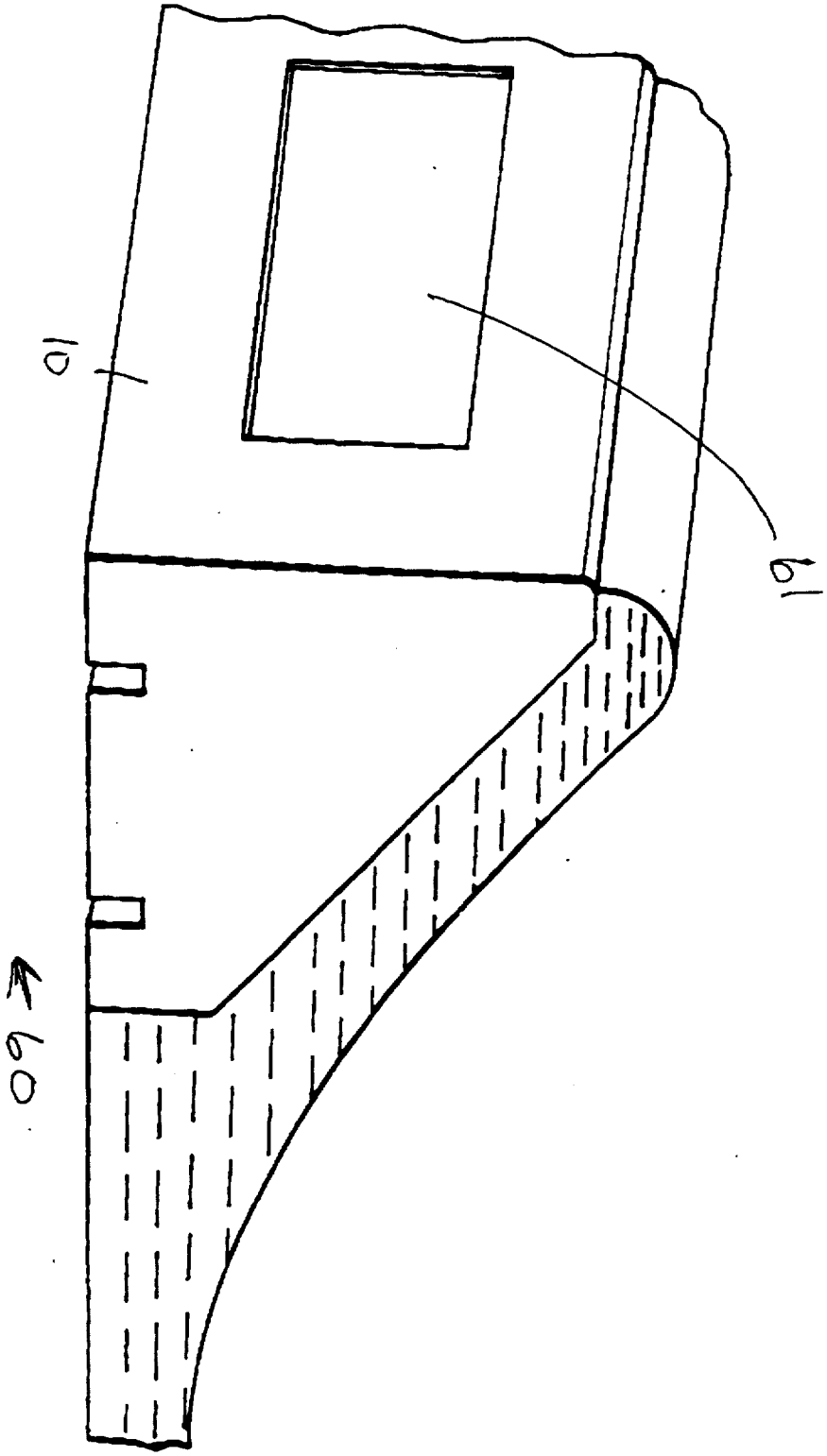

FIG. 9 illustrates an embodiment which allows for a hinged connection. FIG. 10 illustrates an embodiment of the present invention utilizing a means for extending the height of the unit which comprises a solid presentation plate which has two cylindrical poles depending therefrom which are capable of being engaged into recesses formed in the top of the unit. On this presentation plate, permanent advertising may be affixed.

In summary, because of the unique deformable interlocking structures described in the instant application, a lightweight barrier wall may be constructed to surround any object. By utilizing various shapes, the barrier can be constructed to conform to the outline of a stage, an outdoor athletic event, or even indoor events. After positioning of the units, the units may be ballasted to provide greater resistance to pressure and toppling, however, some embodiments utilize a positive interlock design which does not require ballasting. The nonpositive interlocking embodiments, however, utilize an interlocking system which becomes stronger as the unit is ballasted with a liquid or fluid ballast. In areas where water is not available, sand or polystyrene pellets may be utilized. The invention provides for an area on each unit for advertising and provides structures to protect the advertisement from weather. Upon completion of the event, the ballast may be removed from each unit through means for discharging which may comprise a drain hole located at the bottom of the unit. The units may then be disconnected from contiguous units and stacked on a truck and transported to another location and reused.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A crowd control barrier system comprising:

(a) a plurality of portable, reusable substantially hollow containers made from a lightweight, resiliently deformable material, each container having an exterior surface extending between a first end and an opposing second end and an interior surface defining a cavity;

(b) means for filling the cavity of each container with a material to ballast each container;

(c) a tongue projecting from the exterior surface of the first end of each container; and (d) a receiving aperture positioned on the exterior surface of the second end of each container, each aperture being configured so as to selectively receive the tongue of an adjacent container prior to the container being filled with the ballast, the receiving aperture being recessed within the cavity of each container so as to constrict and engage the tongue as the cavity is filled with the ballast.

2. A crowd control barrier system as claimed in claim 1, further comprising means for extending the height of one of the containers.

3. A crowd control barrier system as recited in claim 2, wherein said means for extending the height of one of the containers comprise a recess dimensioned to receive and support one end of an elongated member having a predetermined length extending vertically upward from the container.

4. A crowd control barrier system as recited in claim 1, wherein at least one container further comprises an indentation formed in the exterior surface of the container, the indentation being capable of receiving and presenting printed advertisements.

5. A crowd control barrier system as recited in claim 1, wherein at least one hollow container is curved such that the container forms an arcuate shape, permitting the combination of the plurality of containers to form a barrier in a plurality of configurations.

6. A crowd control barrier system as recited in claim 1, wherein the tongue comprises a mortise and the receiving aperture comprises a tenon, the mortise being so sized and configured as to correspond with the tenon to form a positive lock between the two units.

7. A crowd control barrier system as recited in claim 1, wherein the tongue comprises a spline and the receiving aperture comprises a groove.

8. A crowd control barrier system as recited in claim 7, wherein the spline further comprise a protuberance extending outwardly from the spline and the groove is configured to receive the spline so as to form a positive lock when the containers are pressed together.

9. A crowd control barrier system as recited in claim 1, wherein the tongue includes an internal chamber in communication with the cavity of each container so that as the cavity is filled with the ballast, the internal chamber is also filled with the ballast to radially expand the tongue.

10. A crowd control barrier system comprising:

(a) a portable, reusable container made from a resiliently deformable material and having an interior surface defining a cavity therein, the container further having an exterior surface defining an opening in communication with the cavity to enable the cavity to be filled with a ballast material, the container further comprising a bottom, opposing sides, opposing ends, and a top;

(b) means for coupling adjacent ends of a pair of individual containers, the coupling means comprising:

(i) an elongated slot recessed within the bottom of the container and extending through one of the ends;

(ii) an elongated member configured to be received within the elongated slot so as to project out of one of the containers, the elongated member also being so sized and configured that as the ballast material is filled into the cavity, the resiliently deformable material of the cavity deforms, clamping the elongated member within the elongated slot.

11. A crowd control barrier system as recited in claim 10, further comprising a plurality of elongated slots recessed within the bottom of the container and extending through one of the ends.

12. A crowd control barrier system as recited in claim 10, further comprising a pair of elongated slots recessed within the bottom of the container, each of the pair of elongated slots extending through one of the opposing ends.

13. A crowd control barrier system as recited in claim 10, wherein the elongated member comprises a wood 2×4.

14. A crowd control barrier as recited in claim 10, further comprising an advertising display mounted on the exterior surface of the container.

15. A crowd control barrier as recited in claim 10, wherein the container is curved along its longitudinal axis.

16. A crowd control barrier system comprising:

(a) a plurality of portable, substantially hollow containers made from a resiliently deformable material, each container having an exterior surface extending between a first end and an opposing second end and an interior surface defining a cavity;

(b) means for filling the cavity of each container with a material to ballast each container;

(c) a receiving aperture positioned on the exterior surface at the second end of each container; and (d) a tongue projecting from the exterior surface at the first end of each container, each tongue being configured so as to selectively be received within an aperture of an adjacent container, the tongue further comprising an internal chamber in communication with the cavity of the container so that the tongue radially expands within the receiving aperture when the cavity is filled with the ballast.

17. A crowd control barrier system as claimed in claim 16, further comprising means for extending the height of one of the containers.

18. A crowd control barrier system as recited in claim 17, wherein said means for extending the height of one of the containers comprise:

(a) an elongated member; and (b) a recess formed in the container, the recess being configured to receive the elongated member so that the elongated member extends vertically upward from the container.

19. A crowd control barrier system as recited in claim 16, wherein at least one of the plurality of containers is curved along its longitudinal axis such that the container forms an arcuate shape, thereby permitting the combination of the plurality of containers to form a barrier in a plurality of configurations.

20. A crowd control barrier system as recited in claim 16, wherein the tongue comprises a mortise and the receiving aperture comprises a tenon, the mortise being so sized and configured as to correspond with the tenon to form a positive lock between the two units.

21. A crowd control barrier system as recited in claim 16, wherein the tongue comprises a spline and the receiving aperture comprises a groove.

22. A crowd control barrier system as recited in claim 21, wherein the spline further comprise a protuberance extending outwardly from the spline and the groove is configured to receive the spline so as to form a positive lock when the containers are pressed together.

23. A crowd control barrier system as recited in claim 16, wherein the receiving aperture is recessed within the cavity of each container so as to constrict and engage the tongue as the cavity is filled with the ballast.

* * * * *

UNITED STATES PATENT AND TRADEMARK OFFICE

CERTIFICATE OF CORRECTION

PATENT NO. : 5,611,641

DATED : March 18, 1997

INVENTOR(S) : Marc E. Christensen

It is certified that error appears in the above-identified patent and that said Letters Patent is hereby corrected as shown below:

In the Drawings:

Delete Drawing Sheets 3 and 5, and substitute the Drawing Sheets consisting of FIGS. 3A-3B, and 5, as shown on the attached pages.

Col. 2, line 34, "4A" should be --3A--

Col. 2, line 37, "4B" should be --3B--

Col. 3, line 59, "29" should be --28--

Col. 5, lines 30, 33, 42, reference numeral "6" should be --5--

Col. 5, line 30, "unit which" should be --unit 10 which--

Col. 5, line 32, "space may" should be --space 61 may--

Col. 5, line 33, "issued" should be --depicted--

Col. 5, line 38, reference numeral "6" should be --1--

UNITED STATES PATENT AND TRADEMARK OFFICE

CERTIFICATE OF CORRECTION

PATENT NO. : 5,611,641

DATED : March 18, 1997

INVENTOR(S) : Marc E. Christensen

It is certified that error appears in the above-identified patent and that said Letters Patent is hereby corrected as shown below:

Col. 5, line 38, reference numeral "70" should be --27--

Col. 5, line 40, "panel 72 located" should be --panel located--

Signed and Sealed this

Sixth Day of January, 1998

*Attest:*

*Attesting Officer*

BRUCE LEHMAN

*Commissioner of Patents and Trademarks*